US007151554B2

(12) United States Patent
Kama

(10) Patent No.: US 7,151,554 B2
(45) Date of Patent: Dec. 19, 2006

(54) THERMAL IMAGE RECORDING APPARATUS

(75) Inventor: Takeshi Kama, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 272 days.

(21) Appl. No.: 10/936,645

(22) Filed: Sep. 9, 2004

(65) Prior Publication Data

US 2005/0068410 A1 Mar. 31, 2005

(30) Foreign Application Priority Data

Sep. 11, 2003 (JP) ..... P. 2003-319896

(51) Int. Cl.
*B41J 2/315* (2006.01)

(52) U.S. Cl. ..... 347/212

(58) Field of Classification Search ..... 347/212, 347/213, 171, 222, 223
See application file for complete search history.

(56) References Cited

U.S. PATENT DOCUMENTS 5,973,714 A * 10/1999 Yoshikawa et al. ..... 347/213
6,064,413 A * 5/2000 Fukui et al. ..... 347/171

FOREIGN PATENT DOCUMENTS

JP 7-299921 A 11/1995

* cited by examiner

*Primary Examiner*—K. Feggins
(74) *Attorney, Agent, or Firm*—Sughrue Mion, PLLC

(57) ABSTRACT

A thermal image recording apparatus has: a thermal head having a glaze in which thermal recording dots are arranged in a one direction, the thermal head conducting thermal recording on a thermal recording material that is to be in contact with the glaze, and transporting the thermal recording material in a direction perpendicular to the arrangement direction of the thermal recording dots; heating unit, disposed downstream from the thermal head in the transport direction, for reheating the rear face opposite to the recording surface of the thermal recording material; and correcting and cooling unit for cooling the reheated thermal recording material while causing the rear face to be concaved.

16 Claims, 5 Drawing Sheets

THERMAL IMAGE RECORDING APPARATUS

This application is based on Japanese Patent application JP 2003-319896, filed Sep. 11, 2003, the entire content of which is hereby incorporated by reference.

BACKGROUND OF THE INVENTION

1. Technical Field of the Invention

The present invention relates to a thermal image recording apparatus for recording an image onto a thermal recording material by heating a glaze formed by an arrangement of thermal recording dots in accordance with image data.

2. Description of the Related Art

Recently, thermal image recording which is conducted on a thermal recording material is used for recording an ultrasonic diagnostic image. The thermal image recording has advantages such as that a wet developing process is not required, that it is easy to handle, and that it can be suitably used in image processing. In recent years, therefore, the use of the thermal image recording is not limited to recording of a small-size image such as that in ultrasonic diagnosis, and application to image recording for medical diagnosis such as MRI diagnosis or X-ray diagnosis in which a large-size high-quality image is requested has been studied.

In thermal image recording, as well known in the art, a thermal head having a glaze in which thermal recording dots (recording dots) for heating a thermal recording layer of a thermal recording material (thermal film) to record an image are arranged in one direction is used, the glaze is slightly pressed against the thermal recording layer of the thermal film, and, in this state, the recording dots of the glaze are heated in accordance with an image to be recorded while the film and the glaze are relatively moved in a direction perpendicular to the arrangement direction of the recording dots, whereby the thermal recording layer of the thermal film is heated to record the image.

On the other hand, in the thermal film, a transparent film is used as a support, and the thermal recording layer is formed on one face of the support. The transparent film functioning as the support is made of, for example, polyethylene terephthalate (PET) (glass transition temperature Tg=69° C.). As the thermal recording layer, for example, useful is a thermal layer that is formed by applying an application solution containing an emulsion in which microcapsules containing at least a basic dye precursor, and a developer are dissolved in an organic solvent sparingly soluble or insoluble in water, and then emulsified and dispersed.

In thermal image recording, relating to the surface of the thermal film in which the transparent film made of an organic resin such as PET is used as a support, usually the thermal recording layer is pressurized and heated by the glaze of the thermal head, and at the same time the rear face of the film is subjected to transportation by a platen roller. In the thermal film in which a PET organic resin film is used as the support, therefore, a force in the contraction direction due to pressurization by the glaze acts on the surface of the thermal film heated to a high temperature, such as the temperature is higher than the glass transition temperature (Tg) of the PET film constituting the support, and a force in the expansion direction due to pulling by the platen roller acts on the rear face. As a result, there arises a problem in that the support of the thermal film is curled toward the pressurized and heated side, i.e. toward the thermal head. Such curling is produced also by a phenomenon that, when the emulsion of the thermal recording layer is dehydrated with heating by the glaze and the film in this state is then cooled, the thermal recording layer is contracted by a degree corresponding to the insufficient water, and hence the recording surface to which heat has been applied is formed into a concaved shape.

In recent years, as described above, a large-size high-quality image is requested in an application such as MRI diagnosis or X-ray diagnosis. Therefore, curling, which has not caused a serious problem in a conventional small-size thermal film, becomes large in degree in accordance with the increased size of a thermal film, thereby causing the thermal film which has undergone thermal recording, to be difficult to handle. Usually, a thermal film is observed while being vertically hung in front of a light box. Consequently, such curling particularly causes the handlability and the visibility to be impaired.

Various improved techniques for reducing the degree of curling in a thermal film have been proposed. In a thermal printing method which uses an apparatus shown in FIG. 7, for example, a printing drum 5 is stopped with using a clamp 3 after a printed image is obtained. Therefore, an end portion in the running direction of a print sheet 7 which is not fixed to the drum 5 is downward moved under the influence of the gravity and the specific rigidity of the sheet, and hence makes contact with a protrusion end portion of a guide plate 9 which is disposed below the drum.

Then, the drum 5 is rotated in a direction opposite to that of the arrow 11, so that the sheet 7 is supplied to rollers 13. Via adequate guide plates, the sheet is thereafter supplied to rollers 15 which are rotated so as to attain the same transporting speed as the printing drum 5. At the same time, the clamp 3 is opened, and hence the sheet 7 is transported toward a heated roller 17.

The roller 17 is used for heating the rear face of the sheet 7 so as to offset a majority of the influence on the recording surface (front face) due to the heating by a printing head 19. Finally, the sheet 7 is supplied by rollers 21 onto a collection tray 25 via a slot opening 23 of a cover. In the figure, 27*a*, 27*b*, and 27*c* denote press rollers which are biased by respective springs.

According to the configuration, the rear face (opposite to the recording surface) of the print sheet 7 is uniformly heated, so that curling due to heating of the sheet 7 by the printing head 19 can be reduced. This is disclosed in JP-A-7-299921.

In the thermal printing method which uses the apparatus described above, however, the heat roller having a relatively large diameter, and the mechanism for inverting a thermal film must be disposed, and therefore the components for decurling increase the installation space, the power consumption, the production cost, and the noise level. The correction is conducted by winding the thermal film around the outer peripheral face of the heat roller. Therefore, the curvature for correction depends on the diameter of the heat roller, and the correction is conducted only at a constant bending amount. When the quantity of heat received by the film is increased by raising the heating temperature or lowering the transporting speed, a phenomenon that the temperature exceeds the development start temperature of the thermal film and the recorded image is darken, or so-called density fogging may occur. Moreover, the quantity of heat applied to the thermal film is varied depending on a recorded image. When a heat roller having a constant curvature is used, therefore, it is impossible to optimumly set the curvature for correction in accordance with a recorded image. As a result, optimum decurling corresponding to a recorded image cannot be conducted, and there arise the possibilities that curl remains, and that the quality of the recorded image is lowered by the decurling process.

SUMMARY OF THE INVENTION

The invention has been conducted in view of the above-described circumstances. It is a first object of the invention to provide a thermal image recording apparatus in which the installation space for a decurling mechanism, the power consumption, the production cost, and the noise level can be suppressed. It is a second object of the invention to provide a thermal image recording apparatus in which decurling corresponding to a recorded image can be conducted without lowering the image quality.

In order to attain the objects, the thermal image recording apparatus of the present invention comprises: a thermal head having a glaze in which thermal recording dots are arranged in a one direction, the thermal head conducting thermal recording on a thermal recording material that is in contact with the glaze, and transporting the thermal recording material in a direction perpendicular to an arrangement direction of the thermal recording dots; heating unit, disposed downstream from the thermal head in a transport direction, for reheating a rear face opposite to a recording surface of the thermal recording material; and correcting and cooling unit for cooling the reheated thermal recording material while causing the rear face to be concaved.

In the thermal image recording apparatus, the thermal recording material which is softened in the vicinity of the glass transition temperature is cooled while being bent in a direction opposite to the curl direction, so that heating, physical correction due to application of an external force, and cooling for maintaining the corrected state are sequentially applied to the thermal recording material which is kept to be in a usual transported state. Therefore, it is not required to dispose a heat roller having a large diameter, and a mechanism for inverting the thermal recording material. Since the thermal recording material is cooled and subjected to the decurling process while being bent in the direction opposite to the curl direction, the excessive heating is not requested.

Preferably, the thermal image is characterized in that the heating unit comprises: a plate heater which is to be in contact with the rear face of the thermal recording material; and a press roller which cooperates with the plate heater to transport the thermal recording material while clampingly holding the thermal recording material.

In the thermal image recording apparatus, the heating unit is configured by a plate heater, and hence the space for installing the heating unit in the thermal image recording apparatus can be reduced as compared with the case of a heating roller in which a heater or the like must be incorporated, and which must be rotatably configured.

Preferably, The thermal image recording apparatus is characterized in that the heating unit comprises: a heat roller which is to be in contact with the rear face of the thermal recording material; and a press roller which cooperates with the heat roller to transport the thermal recording material while clampingly holding the thermal recording material.

In the thermal image recording apparatus, the heating unit is configured by a heat roller. When the heat roller is rotated in synchronization with transportation of the thermal recording material, therefore, a relative rubbing movement between the thermal recording material and the heat roller does not occur.

Also preferably, the thermal image recording apparatus is characterized in that the correcting and cooling unit is disposed in a plural number, downstream from the heating unit in the transport direction across a transport path, and each of the correcting and cooling unit is supported to be vertically movable, thereby enabling the thermal recording material to be bent.

In the thermal image recording apparatus, the correcting and cooling unit which are disposed across the transport path can be moved downward more largely as further advancing toward the downstream in the transport direction, and therefore the transport path can be formed into a curved shape. When the thermal recording material is passed through the curved transport path, the thermal recording material is bent, so that the rear face has a concaved shape.

Also preferably, the thermal image recording apparatus is characterized in that the correcting and cooling unit comprises a flexible guide plate which elongates in the transport direction and downstream from the heating unit in the transport direction, and a part of the guide plate is vertically moved to cause a face which is to be in contact with the thermal recording material, to be bent in a concaved shape.

In the thermal image recording apparatus, when a tip end portion in the transport direction which is a part of the flexible guide plate is moved, the whole flexible guide plate is curved, and, when the transported thermal recording material is further transported along the curved flexible guide plate, the thermal recording material is bent, so that the rear face has a concaved shape.

Also preferably, the thermal image recording apparatus is characterized in that the correcting and cooling unit comprises: a correct roller which is disposed downstream from the heating unit in the transport direction, and which is to be in contact with the rear face of the thermal recording material; and an inclined press roller which is in contact with the correct roller while a rotation center is shifted from a center axis of the correct roller toward a downstream side in the transport direction, thereby transporting the thermal recording material with clampingly holding the thermal recording material while bending the thermal recording material along an outer peripheral face of the correct roller to cause the rear face to be formed into a concaved shape.

In the thermal image recording apparatus, the thermal recording material which is transported from the heating unit is further transported while being clampingly held by the correct roller and the inclined press roller. Therefore, the thermal recording material is bent along the outer peripheral face of the correct roller, so that the rear face has a concaved shape.

Also preferably, the thermal image recording apparatus is characterized in that the apparatus further comprises a cooling fan which sends cooling air to the thermal recording material.

In the thermal image recording apparatus, cooling air blown by the cooling fan strikes the thermal recording material in the state that a physical external force due to bending is applied to the material. Therefore, the thermal recording material can be decurled in a short cooling transport distance.

Also preferably, the thermal image recording apparatus characterized in that the correcting and cooling unit comprises inclination angle setting unit for setting an inclination angle by which the thermal recording material is bent when the thermal recording material is cooled, in accordance with an amount of heat which is applied to the thermal recording material due to image data to be recorded.

In the thermal image recording apparatus, the inclination angle for bending the thermal recording material is set in accordance with the amount of applied heat due to the image data, and the decurling process is conducted while bending the thermal recording material so as to attain the set inclination angle. Therefore, the thermal recording material during the cooling process is bent at an adequate angle corresponding to the image data, so that the decurling process can be surely conducted.

In the thermal image recording apparatus of the present invention, the heating unit for reheating the rear face of the thermal recording material is disposed downstream from the thermal head in the transport direction, and the correcting and cooling unit for cooling the reheated thermal recording material while causing the rear face to be concaved is disposed. Therefore, the thermal recording material which is softened in the vicinity of the glass transition temperature is cooled while being bent in the direction opposite to the curl direction, so that heating, physical correction due to application of an external force, and cooling for maintaining the corrected state are sequentially applied to the thermal recording material which is kept to be in a usual transported state. Consequently, it is not required to dispose a heat roller having a large diameter, and a mechanism for inverting the thermal recording material, with the result that the installation space, the power consumption, the production cost, and the noise level can be suppressed.

Moreover, the bending degree in the decurling process of cooling the thermal recording material while bending the material in a direction opposite to the curl direction is adjusted in accordance with the quantity of heat which is given to the material in order to conduct image recording. Therefore, the decurling process can be adequately conducted in accordance with the image data.

DETAILED DESCRIPTION OF THE INVENTION

Hereinafter, preferred embodiments of the thermal image recording apparatus of the invention will be described in detail with reference to the accompanying drawings.

Figure 1:
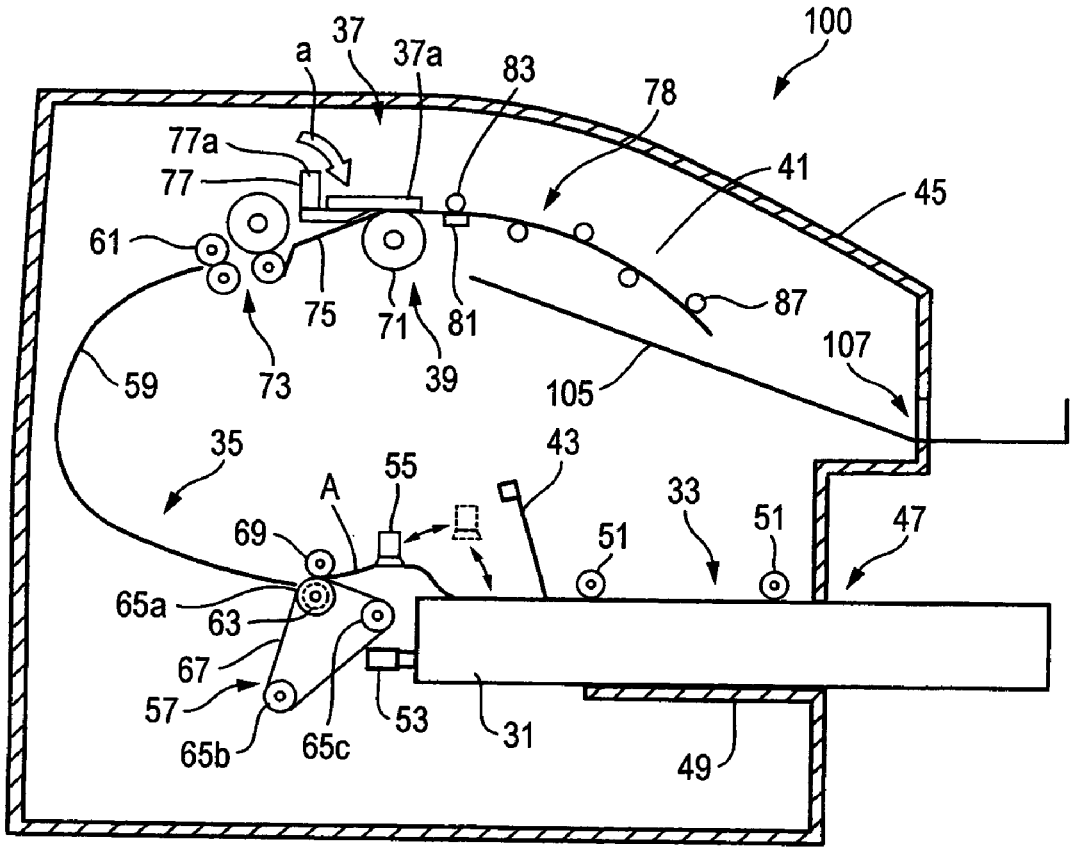
FIG. 1 is a diagram showing the whole of a first embodiment of the thermal image recording apparatus of the invention.
Figure 2:
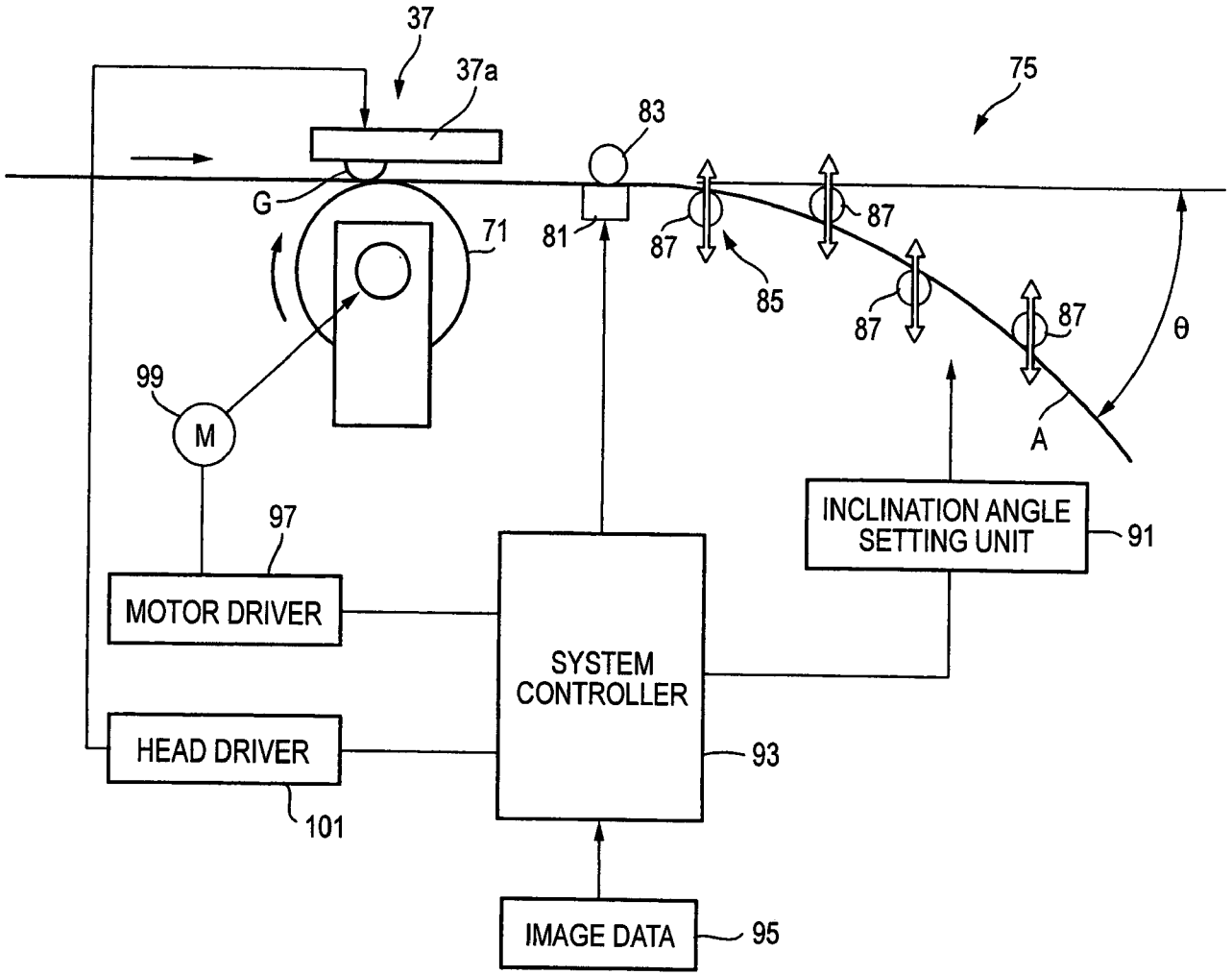
FIG. 2 is a diagram showing main portions of heating unit and correcting and cooling unit of the thermal image recording apparatus of FIG. 1.

FIG. 1 is a diagram showing the whole of a first embodiment of the thermal image recording apparatus of the invention, and FIG. 2 is a diagram showing main portions of heating unit and correcting and cooling unit of the thermal image recording apparatus of FIG. 1.

A thermal image recording apparatus 100 (hereinafter, often referred to also as the recording apparatus 100) conducts thermal image recording on a thermal recording material (hereinafter, referred to as a thermal film) A which is a cut sheet of a predetermined size such as size B4. The recording apparatus has: a loading section 33 into which a magazine 31 accommodating thermal films A is to be loaded; a feeding/transporting section 35; a recording section 39 in which a thermal head 37 conducts thermal image recording on the thermal film A; and a discharging section 41.

Each of the thermal films A uses a transparent film such as polyethylene terephthalate (PET) as a support, and has a thermal recording layer which is formed by applying an application solution to one face of the support. The application solution contains an emulsion in which microcapsules containing at least a basic dye precursor, and a developer are dissolved in an organic solvent sparingly soluble or insoluble in water, and then emulsified and dispersed. Usually, the thermal films A are bundled in a predetermined number, such as 100 sheets, to be packaged in a bag or bound with a band. In the illustrated example, the predetermined number of the thermal films in the form of a bundle are accommodated in the magazine 31 of the recording apparatus 100 in a state where the thermal recording layer of the films indicates downward, and then taken out of the magazine 31 one by one to be subjected to thermal image recording.

The magazine 31 is a case having a cover 43 which is openable and closable. The magazine accommodating the thermal films A is loaded into the loading section 33 of the recording apparatus 100. The loading section 33 has: an insertion port 47 formed in a housing 45 of the recording apparatus 100; a guide plate 49; guide rolls 51, 51; and a stop member 53. The magazine 31 is inserted through the insertion port 47 into the recording apparatus 100 with setting the cover 43 foremost, and then pushed to a position where the magazine butts against the stop member 53, while being guided by the guide plate 49 and the guide rolls 51. As a result, the magazine 31 is loaded to a predetermined position in the recording apparatus 100.

The feeding/transporting section 35 takes out the thermal film A from the magazine 31 loaded into the loading section 33, and then transports the thermal film to the recording section 39. The feeding/transporting section has: a sheet feeding mechanism which uses a sucker 55 for attracting the thermal film A by suction; transporting unit 57; a transport guide 59; and a regulating roller pair 61 located in the outlet of the transport guide 59. The transporting unit 57 is composed of: a transport roller 63; a pulley 65*a* which is coaxial with the transport roller 63; a pulley 65*b* coupled to a rotating drive source; a tension pulley 65*c*; an endless belt 67 stretched around the three pulleys 65*a*, 65*b* and 65*c*; and a nip roller 69 which is pressed against the transport roller 63. The front end of the thermal film A which is separately fed by the sucker 55 is clampingly held by the transport roller 63 and the nip roller 69, and the thermal film A is then transported.

The feeding/transporting section 35 operates in the following manner. When the recording apparatus 100 issues instructions for starting a recording process, the cover 43 is opened by an opening/closing mechanism which is not shown, and the sheet feeding mechanism using the sucker 55 takes out one of the thermal films A from the magazine 31, and supplies the front end of the thermal film A to the transporting unit 57 (the roller 63 and the nip roller 69). At the timing when the thermal film A is clampingly held by the transport roller 63 and the nip roller 69, the suction by the sucker 55 is released, and the supplied thermal film A is then transported to the regulating roller pair 61 by the transporting unit 57 while being guided by the transport guide 59. At the timing when the thermal film A to be subjected to recording is completely discharged from the magazine 31, the cover 43 is closed by the opening/closing mechanism.

The distance between the transporting unit 57 and the regulating roller pair 61 which is defined by the transport guide 59 is set to be somewhat shorter than the length of the thermal film A in the transport direction. Although the front end of the thermal film A reaches the regulating roller pair 61 as a result of the transportation by the transporting unit 57, the regulating roller pair 61 is initially at rest, and hence the front end of the thermal film A is stopped at this position. At the timing when the front end of the thermal film A reaches the regulating roller pair 61, the temperature of the thermal head 37 is detected. If the detected temperature has a predetermined value, the transportation of the thermal film A by the regulating roller pair 61 is started so that the thermal film A is transported to the recording section 39.

The recording section 39 has the thermal head 37, a platen roller 71, a transporting roller pair 73, a guide 75, and a decurling section 78 which constitutes a characteristic portion of the present invention. The thermal head 37 conducts thermal image recording, for example the thermal head can be applied onto a sheet of size B4 at the maximum, and in which the recording (pixel) density is about 300 dpi. The thermal head 37 has a thermal head body 37*a* in which a glaze G (see FIG. 2) is formed, and a heat sink (not shown) which is fixed to the thermal head body 37*a*. In the glaze, thermal recording dots which conduct thermal recording on the thermal film A are arranged in a one direction (perpendicular to the plane of the paper of the figure). The thermal head 37 is supported on a support member 77 which is swingable about a fulcrum 77*a* in the direction of the arrow a and in the opposite direction. The platen roller 71 is rotated at a specified image recording speed while holding the thermal film A to a predetermined position, to transport the thermal film A in a direction perpendicular to the elongating direction of the glaze G.

Before the thermal film A is transported, the support member 77 is swung in an upward direction (the direction opposite to that of the arrow a), and hence not in contact with the thermal head 37 and the platen roller 71. When the transportation of the thermal film A by the regulating roller pair 61 is started, the thermal film A is clampingly held by the transporting roller pair 73, and then transported with being guided by the guide 75. When the front end of the thermal film A reaches the recording start position (the position corresponding to the glaze), the support member 77 is swung in the direction of the arrow a to attain a state where the thermal film A is clampingly held by the glaze G of the thermal head 37 and the platen roller 71, and the glaze G is pressed against the thermal recording layer. Thereafter, the thermal film A is transported by the platen roller 71 (and the regulating roller pair 61 and the transporting roller pair 73) while being held to the predetermined position by the platen roller 71. With advance of the transportation, the recording dots of the glaze G are heated in accordance with an image to be recorded, thereby conducting thermal image recording on the thermal film A.

The decurling section 78 comprises heating unit and correcting and cooling unit. The heating unit is composed of a plate heater 81 which is to be in contact with the rear face of the thermal film A, and a press roller 83 which cooperates with the plate heater 81 to transport the thermal film A while clampingly holding the film. The plate heater 81 heats the thermal film A to the glass transition temperature (about 70° C.), whereby so-called stiffness of the thermal film A which is curled can be eliminated, or correction is facilitated. Because of the plate heater 81, the space for installing the heater in the thermal image recording apparatus can be reduced as compared with the case of a heating roller in which a heater or the like must be incorporated, and which must be rotatably configured. The plate heater 81 and the press roller 83 are disposed downstream from the platen roller 71 in the transport direction so as to reheat the rear face opposite to the recording surface of the thermal film A. As the press roller 83, a rubber roller in which the temperature distribution in the axial direction is more uniform than that in a metal roller can be preferably used.

As shown in FIG. 2 in detail, the correcting and cooling unit is composed of plural (in the illustrated example, four) correcting and cooling rollers 87 which are disposed downstream from the plate heater 81 and the press roller 83 in the transport direction, and which are juxtaposed in a staggered manner across a transport path 85. The correcting and cooling rollers 87 has a predetermined heat capacity to absorb heat of the thermal film A which is in contact therewith, thereby cooling the thermal film A. Namely, the reheated thermal film A is caused to cool, by the correcting and cooling unit, and makes contact with the correcting and cooling rollers 87 to be cooled to the glass transition temperature or lower.

Each of the correcting and cooling rollers 87 is supported so as to be movable in a direction perpendicular to the face of the thermal film A. The correcting and cooling rollers 87 which are juxtaposed in a staggered manner across the transport path 85 are moved further largely toward, for example, the lower side in FIG. 2 as disposed further downstream in the transport direction, thereby enabling the transport path 85 to be curvedly formed so as to be inclined by an angle θ on the whole. When the thermal film A is passed through the curved transport path 85, therefore, the thermal film is bent so that the rear face is concaved. Rubber rollers, felt rollers, flocked rollers, or other rollers may be preferably used as the correcting and cooling rollers 87. Although not shown, a guide roller, a guide plate, or other unit may be disposed in the transport path 85 between the juxtaposed correcting and cooling rollers 87, so that the curved thermal film A is introduced sequentially to the correcting and cooling rollers 87 toward the downstream side.

Although the inclination angle θ depends on image data to be recorded, the angle is set to about 30±10° C.

The correcting and cooling rollers 87 are coupled to inclination angle setting unit 91 which enables the rollers to be vertically moved. For example, the inclination angle setting unit 91 may be configured by: bearings which swingably support rotation shafts of the correcting and cooling rollers 87; linear guides which support the bearings so as to be vertically movable; and a rack-and-pinion mechanism comprising electric motors which drive upward or downward the bearings along the linear guides in accordance with an input of an inclination angle setting signal. According to the configuration, in accordance with the inclination angle setting signal, the inclination angle setting unit 91 variably controls the inclination angle which is the bent angle of the thermal film A.

The inclination angle setting unit 91 is connected through an electric signal line to a system controller 93 serving as a controlling section. The system controller 93 supplies the inclination angle setting signal corresponding to image data 95, to the inclination angle setting unit 91. Therefore, the inclination angle setting unit 91 changes the positions of the correcting and cooling rollers 87 on the basis of the inclination angle setting signal, so that the bent angle of the thermal film A can be changed in accordance with the image data. Specifically, in the thermal film A which is subjected to thermal image recording, the degree of curling is changed depending on whether the recorded image is an image having many black areas or that having less black areas (or whether the quantity of applied heat is large or small). The system controller 93 determines the average density of the image to be recorded, and the like from the image data 95, and changes the bent angle of the thermal film A in accordance with the determined data. In the case where an image has a large average density (the quantity of applied heat is large) and the degree of curling is expected to be large, for example, the movement distances of the correcting and cooling rollers 87 are set large so as to increase the inclination angle θ of the transport path 85, thereby increasing the bent angle of the thermal film A. In the case where the degree of curling is expected to be small, the bent angle is reduced in contrast to the above.

In the case of an image having a density which does not require the decurling process, the thermal film A may be heated to a temperature which is lower than the glass transition temperature. In this case, wasteful heating is not conducted, and hence the film can be prevented from being accidentally curled due to heating to the glass transition temperature or higher.

The system controller 93 further controls a driving motor 99 via a motor driver 97 to control the driving of the platen roller 71. The system controller controls also the heat generation of the thermal recording dots in the glaze G, through a head driver 101.

As shown in FIG. 1, the thermal film A which has been subjected to thermal image recording and corrected to a flat shape as described above is transported to the platen roller 71, the press roller 83, and the correcting and cooling rollers 87, and then discharged onto a tray 105 of the discharging section 41. The tray 105 projects to the outside of the recording apparatus 100 through a discharge port 107 formed in the housing 45. The thermal film A on which an image is recorded is discharged to the outside through the discharge port 107, and then taken out.

In the thermal image recording apparatus 100, therefore, the thermal film A which is softened in the vicinity of the glass transition temperature is cooled while being bent in a direction opposite to the curl direction, so that heating, physical correction due to application of an external force, and cooling for maintaining the corrected state are sequentially applied to the thermal film A which remains in the usual transported state. Unlike a conventional apparatus, therefore, it is not required to dispose a heat roller having a large diameter, and a mechanism for inverting the thermal film A.

Moreover, the bending degree in the decurling process for cooling the thermal recording material while bending the material in a direction opposite to the curl direction is adjusted in accordance with the quantity of heat which is given to the material in order to conduct image recording. Therefore, the decurling process can be adequately conducted in accordance with image data.

Because of the decurling process, when the thermal film A is discharged to the outside of the thermal image recording apparatus, the effect of lowering the temperature of the thermal film A is highly produced. Therefore, the thermal film A can be discharged at a temperature which is so low that the user does not feel uncomfortable. Moreover, the decurling process can be conducted at a temperature lower than 80° C. at which temperature fogging occurs. Therefore, it is possible to maintain a desired image quality.

Next, a second embodiment of the thermal image recording apparatus of the invention will be described.

Figure 3:
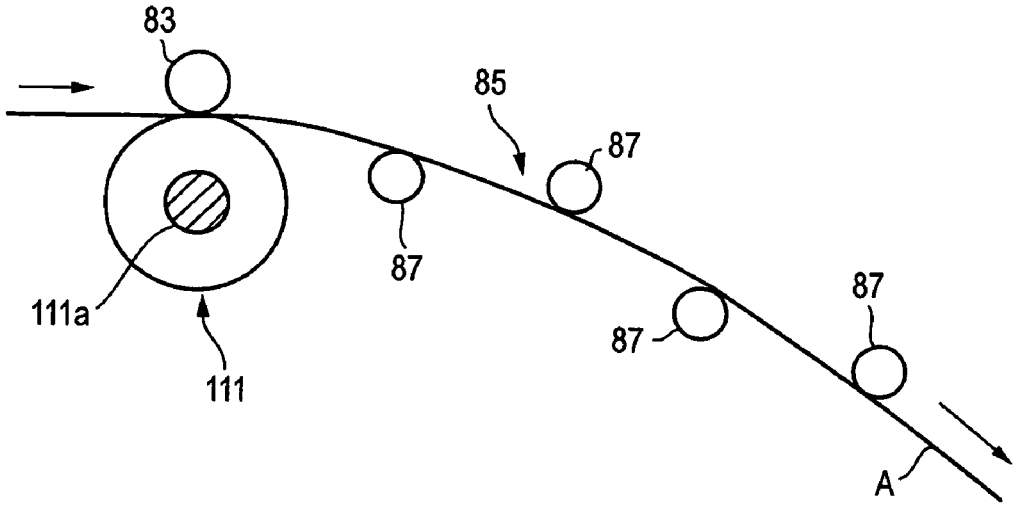
FIG. 3 is a diagram showing main portions of a second embodiment in which a heat roller is used as the heating unit.

FIG. 3 is a diagram showing main portions of the second embodiment in which a heat roller is used as the heating unit. In the following description of the embodiments, the components identical with those shown in FIGS. 1 and 2 are denoted by the same reference numerals, and their duplicated description is omitted.

In the thermal image recording apparatus, the heating unit is composed of a heat roller 111 which is to be in contact with the rear face of the thermal film A, and the press roller 83 which cooperates with the heat roller 111 to transport the thermal film A while clampingly holding the film. The heat roller 111 incorporates a heating source such as a halogen heater 111*a*.

In the thermal image recording apparatus, the heating unit is configured by the heat roller 111. When the heat roller 111 and the press roller 83 are rotated in synchronization with transportation of the thermal film A, a relative rubbing movement between the thermal film A and the heating unit can be eliminated, and hence the thermal recording layer of the thermal film A is not damaged.

Next, a third embodiment of the thermal image recording apparatus of the invention will be described.

Figure 4:
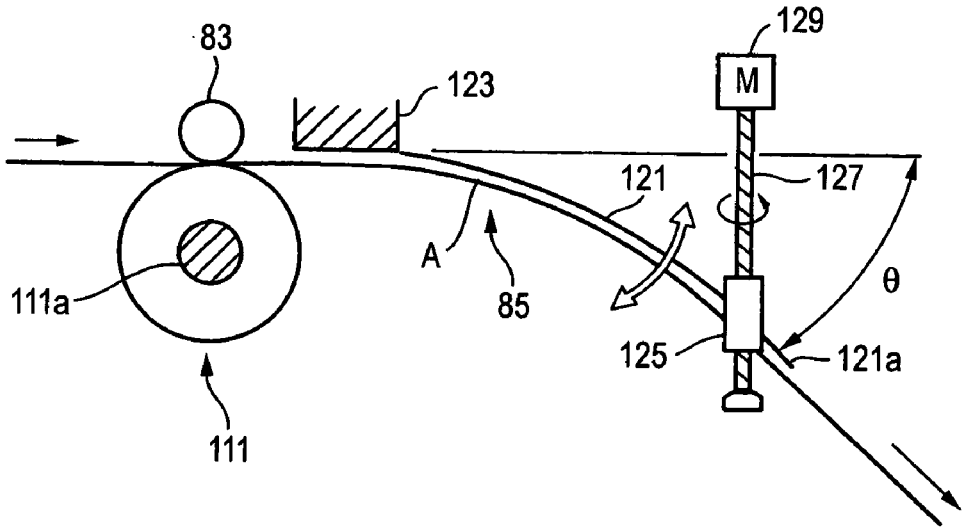
FIG. 4 is a diagram showing main portions of a third embodiment which comprises a flexible guide plate.

FIG. 4 is a diagram showing main portions of the third embodiment which comprises a flexible guide plate.

In the thermal image recording apparatus, the heating unit is composed of the heat roller 111 and the press roller 83, and the correcting and cooling unit is composed of a flexible guide plate 121 which is disposed downstream from the heating unit in the transport direction and elongates along the transport direction, and in which only a tip end portion 121*a* in the transport direction is movable in a direction perpendicular to the face of the thermal film A. As the flexible guide plate 121, for example, a metal plate made of stainless steel can be preferably used.

In the flexible guide plate 121, the basal end is fixed to a fixation block 123, and the transport-direction tip end portion 121*a* which functions as a free end is coupled to the inclination angle setting unit 91 (see FIG. 2). In the embodiment, for example, the inclination angle setting unit 91 may be configured by: a nut member 125 which is fixed to the transport-direction tip end portion 121*a* of the flexible guide plate 121; a rod screw 127 which is screwed with the nut member 125; and a driving motor 129 which rotates the rod screw 127. The driving of the driving motor 129 is controlled by the system controller 93.

According to the configuration, the transport-direction tip end portion 121*a* of the flexible guide plate 121 is moved in accordance with the image data 95, whereby the whole flexible guide plate 121 is curved. When the front end of the thermal film A is transported along the curved flexible guide plate 121, the thermal film A is bent at an angle corresponding to the image data 95 so that the rear face is concaved. In the thermal image recording apparatus, the continuous transport path 85 is formed by the flexible guide plate 121, so that the thermal film A can be smoothly transported.

Next, a fourth embodiment of the thermal image recording apparatus of the invention will be described.

Figure 5:
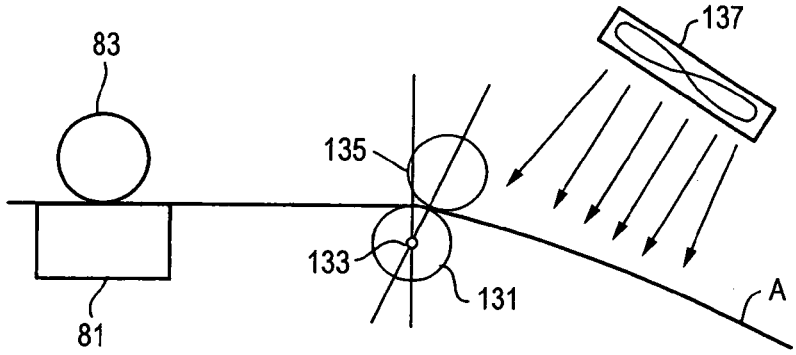
FIG. 5 is a diagram showing main portions of a fourth embodiment which comprises a correct roller, an inclined press roller, and a cooling fan.

FIG. 5 is a diagram showing main portions of the fourth embodiment which comprises a correct roller, an inclined press roller, and a cooling fan.

In the thermal image recording apparatus, the correcting and cooling unit is composed of a correct roller 131, an inclined press roller 135, and a cooling fan 137. The correct roller 131 is disposed downstream from the plate heater 81 and the press roller 83 which serve as the heating unit, in the transport direction, and makes contact with the rear face of the thermal film A. The rotation center of the inclined press roller 135 is shifted downstream in the transport direction with respect to the center axis 133 of the correct roller 131, so that the inclined press roller is in contact with the correct roller 131 while being inclined by a predetermined angle θ. According to the configuration, the inclined press roller 135 transports the thermal film A while clampingly holding the thermal film and bending the film along the outer peripheral face of the correct roller 131, so that the rear face has a concaved shape. The cooling fan 137 is disposed downstream from the correct roller 131 and the inclined press roller 135 in the transport direction, and supplies cooling air to the thermal film A.

In the thermal image recording apparatus, the thermal film A which is transported from the plate heater 81 and the press roller 83 serving as the heating unit is further transported while being clampingly held by the correct roller 131 and the inclined press roller 135, whereby the thermal film is bent along the outer peripheral face of the correct roller 131. In the state where a physical external force due to the bending is applied to the thermal film A, the cooling air blown by the cooling fan 137 strikes the thermal film, and the shape of the thermal film A in the decurled state is held. The air blowing by the cooling fan 137 improves the cooling efficiency. Therefore, the transport distance in the cooling section can be shortened. This can contribute to downsizing of the apparatus.

Next, a fifth embodiment of the thermal image recording apparatus of the invention will be described.

Figure 6:
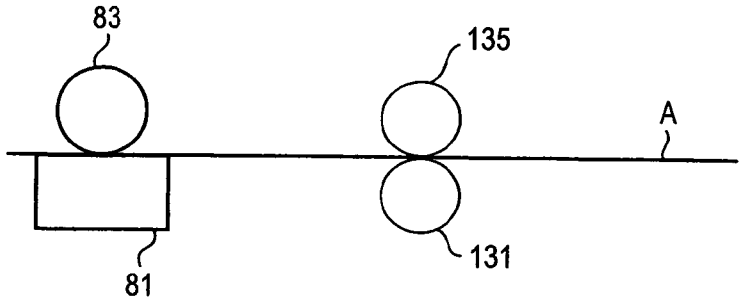
FIG. 6 is a diagram showing main portions of a fifth embodiment in which the inclined press roller is movably disposed.
Figure 6:
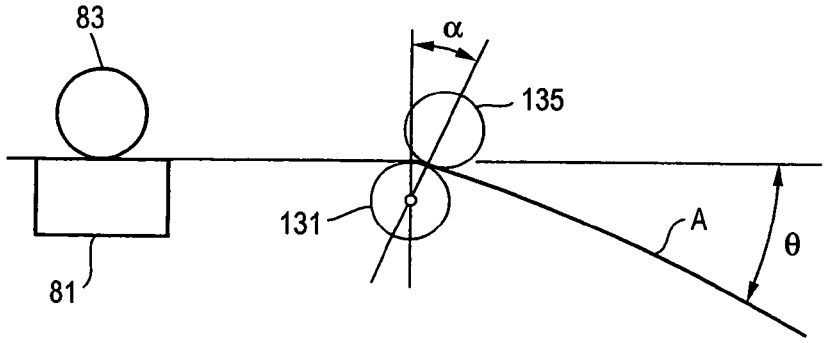
Figure 7:
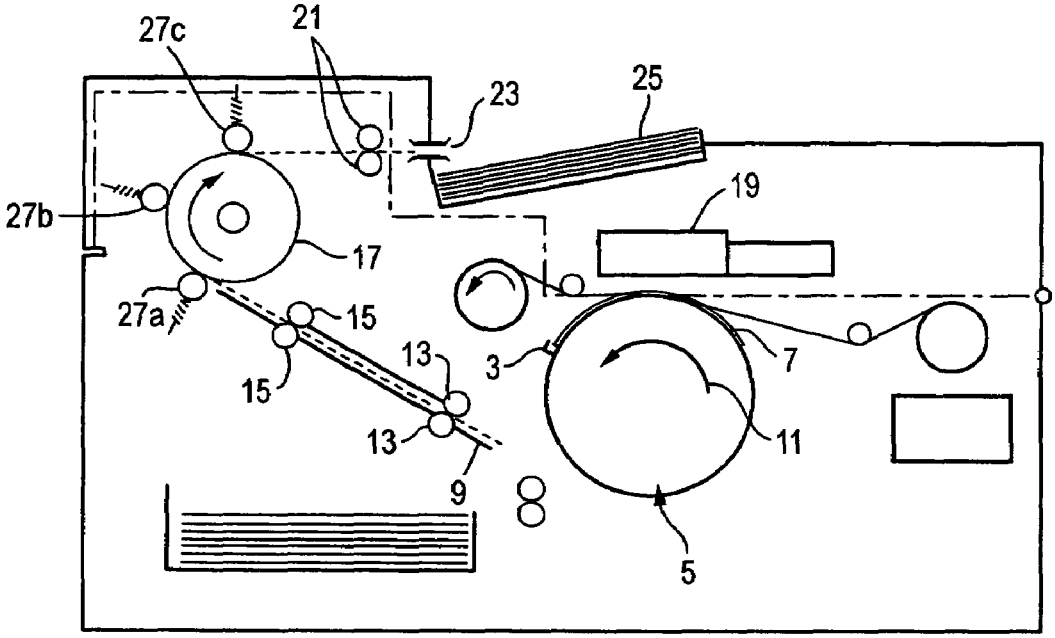
FIG. 7 is a diagram schematically showing a conventional thermal image recording apparatus.

FIG. 6 is a diagram showing main portions of the fifth embodiment in which the inclined press roller is movably disposed.

In the thermal image recording apparatus, the inclined press roller 135 is movably supported so as to be transferred between the state where the inclined press roller is not shifted as shown in FIG. 6A, and that where an arbitrary shift angle α is formed as shown in FIG. 6B. The inclined press roller 135 is disposed so as to be rollable on the outer peripheral face of the correct roller 131 in a predetermined range. The inclination angle α of the inclined press roller 135 is controlled by the inclination angle setting unit 91 in accordance with the inclination angle setting signal which is supplied from the system controller 93, and which corresponds to the image data 95.

In the thermal image recording apparatus, since the inclined press roller 135 is movable so as to obtain an arbitrary shift angle, the bent angle θ of the thermal film A is made variable in accordance with the image data 95 by the simple structure and the small number of components.

The present invention is not limited to the specific above-described embodiments. It is contemplated that numerous modifications may be made to the present invention without departing from the spirit and scope of the invention as defined in the following claims.

What is claimed is:

1. A thermal image recording apparatus comprising:

a thermal head having a glaze in which thermal recording dots are arranged in one direction, the thermal head conducting thermal recording on a thermal recording material that is in contact with the glaze, and transporting the thermal recording material in a direction perpendicular to an arrangement direction of the thermal recording dots;

a heating unit disposed downstream of the thermal head in a transport direction, for reheating a rear face opposite to a recording surface of the thermal recording material; and a correcting and cooling unit for cooling the reheated thermal recording material in a state where the thermal recording material is bent so that the rear face is concaved.

2. The thermal image recording apparatus according to claim 1, wherein the heating unit comprises:

a plate heater which is to be in contact with the rear face of the thermal recording material; and a press roller which cooperates with the plate heater to transport the thermal recording material while holding the thermal recording material.

3. The thermal image recording apparatus according to claim 1, wherein the heating unit comprises:

a heat roller which is to be in contact with the rear face of the thermal recording material; and a press roller which cooperates with the heat roller to transport the thermal recording material while holding the thermal recording material.

4. The thermal image recording apparatus according to claim 1, wherein the thermal image recording apparatus has a number of the correcting and cooling units disposed downstream of the heating unit in the transport direction across a transport path, and each of the correcting and cooling unit is supported to be vertically-movable, thereby enabling the thermal recording material to be bent.

5. The thermal image recording apparatus according to claim 1, wherein the correcting and cooling unit comprises a flexible guide plate which elongates downstream of the heating unit in the transport direction, and a part of the flexible guide plate is capable of being vertically moved to cause a face which is to be in contact with the thermal recording material, to be bent in a concaved shape.

6. The thermal image recording apparatus according to claim 1, wherein the correcting and cooling unit comprises:

a correct roller which is disposed downstream of the heating unit in the transport direction, and which is to be in contact with the rear face of the thermal recording material; and an inclined press roller which is in contact with the correct roller while a rotation center is shifted from a center axis of the correct roller toward a downstream side in the transport direction, thereby transporting the thermal recording material with holding the thermal recording material while bending the thermal recording material along an outer peripheral face of the correct roller to cause the rear face to be formed into a concaved shape.

7. A thermal image recording apparatus according to claim 6, wherein the apparatus further comprises a cooling fan which sends cooling air to the thermal recording material.

8. The thermal image recording apparatus according to claim 1, wherein the correcting and cooling unit comprises an inclination angle setting unit for setting an inclination angle by which the thermal recording material is bent when the thermal recording material is cooled, in accordance with an amount of heat which is applied to the thermal recording material due to image data to be recorded.

9. A process for thermal recording, comprising steps of:

recording a thermal recording material by a thermal head having a glaze in which thermal recording dots are arranged in one direction;

heating a rear face opposite to a recording surface of the recorded thermal recording material by a heating unit;

transporting the reheated thermal recording material; and cooling the reheated thermal recording material while the thermal recording material is bent so that the rear face is concaved.

10. The process according to claim 9, wherein the heating unit comprises:

a plate heater which is to be in contact with the rear face of the thermal recording material; and a press roller which cooperates with the plate heater to transport the thermal recording material while holding the thermal recording material.

11. The process according to claim 9, wherein the heating unit comprises:

a heat roller which is to be in contact with the rear face of the thermal recording material; and a press roller which cooperates with the heat roller to transport the thermal recording material while holding the thermal recording material.

12. The process according to claim 9, wherein the cooling is performed by using a number of correcting and cooling units disposed downstream from the heating unit in a transport direction across a transport path, each of the correcting and cooling unit being supported to be vertically movable, thereby enabling the thermal recording material to be bent.

13. The process according to claim 9, wherein the cooling is performed by a correcting and cooling unit comprising a flexible guide plate which elongates downstream of the heating unit in the transport direction, and a part of the flexible guide plate is capable of being vertically moved to cause a face, which is to be in contact with the thermal recording material, to be bent in a concaved shape.

14. The process according to claim 9, wherein cooling is performed by a correcting and cooling unit comprising:

a correct roller which is disposed downstream of the heating unit in the transport direction, and which is to be in contact with the rear face of the thermal recording material; and an inclined press roller which is in contact with the correct roller while a rotation center is shifted from a center axis of the correct roller toward a downstream side in the transport direction, thereby transporting the thermal recording material with holding the thermal recording material while bending the thermal recording material along an outer peripheral face of the correct roller to cause the rear face to be formed into a concaved shape.

15. The process for thermal recording according to claim 14, wherein the cooling is performed by further using a cooling fan which sends cooling air to the thermal recording material.

16. The process for thermal recording according to claim 9, wherein the cooling is performed by using a correcting and cooling unit comprising an inclination angle setting unit for setting an inclination angle by which the thermal recording material is bent when the thermal recording material is cooled, in accordance with an amount of heat which is applied to the thermal recording material due to image data to be recorded.

* * * * *